US005205799A

United States Patent [19]

Carbonero

[11] Patent Number: 5,205,799

[45] Date of Patent: Apr. 27, 1993

[54] TELESCOPING HURDLE WITH BASE ADAPTER

[75] Inventor: Kurt K. Carbonero, Birmingham, Mich.

[73] Assignee: Pull-Buoy, Inc., Rochester Hill, Mich.

[21] Appl. No.: 817,607

[22] Filed: Jan. 7, 1992

[51] Int. Cl.[5] ..... A63B 5/02

[52] U.S. Cl. ..... 482/16; 482/14; 482/148

[58] Field of Search ..... 116/63 C; 40/606; 248/910, 523, 346; 404/9, 10, 11; 482/16, 17, 81; 119/29

[56] References Cited

U.S. PATENT DOCUMENTS

| | | | |
|---|---|---|---|
| 1,737,108 | 11/1929 | Craig | 482/17 |
| 1,767,434 | 6/1930 | Edelmann | 248/910 |
| 2,677,544 | 6/1950 | Desselman | 484/17 |
| 3,620,235 | 7/1970 | Palazzolo et al. | 404/9 |
| 4,232,862 | 11/1980 | Mason | 482/16 |

FOREIGN PATENT DOCUMENTS

| | | | |
|---|---|---|---|
| 2587050 | 3/1987 | France | 404/9 |

*Primary Examiner*—Richard J. Apley
*Assistant Examiner*—Jerome Donnelly
*Attorney, Agent, or Firm*—Reising, Ethington, Barnard, Perry & Milton

[57] ABSTRACT

A playground base and standard assembly (10) includes a typical hollow traffic cone (28) having a top hole (20) for receiving a standard (12) into the cone (28). The cone (28) is modified by placing an insert (26) inside the cone for stabilizing the standard (12). The insert (26) is a solid polyethylene foam member shaped to fit snugly in the cone (28). The insert (26) has a hole (34) coaxial with a top hole (20) on the cone (28) for receiving and supporting any standard (12). One possible standard (12) includes telescoping members (40,42) for adjusting the height of the standard.

17 Claims, 1 Drawing Sheet 46
48
44
52
15
42
50
12
10
16
40
18
24
20
16
18
10
14
22
34
30
38
36
26
32
14

10
26
22
24
14
32

TELESCOPING HURDLE WITH BASE ADAPTER

TECHNICAL FIELD

The subject invention relates to playground or gym equipment, and more specifically to bases for supporting gym standards or poles.

BACKGROUND OF THE INVENTION

All school playgrounds and gyms use standard hollow traffic cones for a variety of purposes. However, as of yet there has been no effective way for the cones to be used as base standards. An end of a pole could be placed through the top hole in the cone, with the remainder of the pole extending upwardly. These poles could be used in turn to support hurdle bars and hockey goals, among other things. Unfortunately, the traffic cones do not support the poles well because the top hole in the cone is often too large for the pole and because there is nothing within the hollow cone to support the end of the pole which is in the hollow space. In other words, the pole does not fit snugly within the cone. Thus, when a force is applied to the end of the pole which is outside the cone, there is no counter force at the pole's other end to stabilize the pole. The pole merely pivots around the top hole. Needless to say, this arrangement leaves something to be desired.

U.S. Pat. No. 4,232,862 teaches the use of an adapter on the end of a pole in order to stabilize the pole in the top hole of a traffic cone. The adapter is simply a tube having a flange end for engaging the top hole and preventing the tube from passing completely through the top hole and into the hollow space defined by the cone. Unfortunately, the adapter only reduces the space between the pole and the top hole: it does not prevent the end of the pole from moving about the hollow space within the cone. The adapter may provide some additional support for a pole extending horizontally from the cone; but the adapter provides little or no additional support for poles extending vertically from the cone.

SUMMARY OF THE INVENTION AND ADVANTAGES

A playground base and standard assembly comprises support means including a base, a top, a conical wall extending between the base and the top, a top hole through the top and a base hole through the base. The support means also includes a conical inner space defined by the wall and extending between the base hole and the top hole. The assembly is characterized by including stabilizing means for supporting a standard disposed within the inner space and for engaging the conical wall in order to eliminate movement of the standard with respect to the support means.

The stabilizing means thus acts as an adapter for standard traffic cones, allowing them to be used effectively as support bases for gym standards. These standards could support a hurdle, or goals for hockey and soccer, for example. This saves the schools money because it enables schools to make use of a product which they already have: schools therefore need not buy a new base.

The subject invention further provides a light weight, easy to assemble base. Since the base is so light, young children can move it. This saves the time and energy of the gym teacher or playground supervisor. Also, the base can be assembled and disassembled easily: the parts all fit snugly together and do not require tools or screws. Since the assembly breaks down into small pieces it requires little space for storage.

FIGURES IN THE DRAWINGS

Other advantages of the present invention will be readily appreciated as the same becomes better understood by reference to the following detailed description when considered in conjunction with the accompanying drawings wherein.

DETAILED DESCRIPTION OF THE PREFERRED EMBODIMENT

Figures 1, 2, 3:
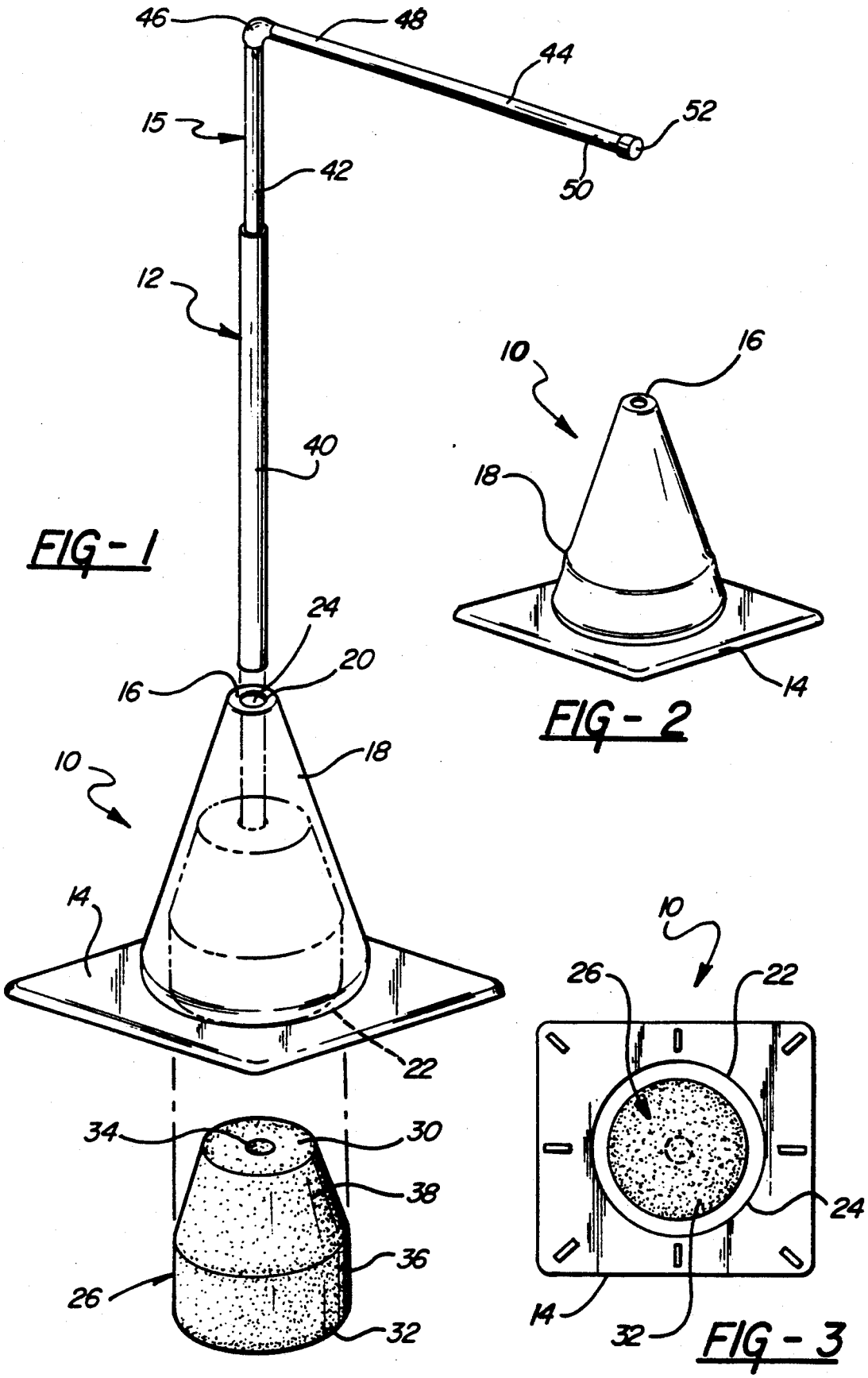
FIG. 1 is an exploded perspective view of the subject invention.
FIG. 2 is a perspective view of the support means with the stabilizing means disposed therein.
FIG. 3 is bottom view of the support means with the stabilizing means disposed therein.

The playground base and standard assembly generally shown at 10 comprises support means generally indicated at 28 including a base 14, a top 16 and a conical wall 18 extending between the base 14 and the top. The assembly 10 also includes a top hole 20 through the top 16, a base hole 22 through the base 14 and a conical inner space 24 defined by the wall 18 and extending between the base hole 22 and the top hole 20. The assembly 10 is characterized by including stabilizing insert means generally indicated at 26 for supporting a standard generally indicated at 12 disposed within the inner space 24 and engaging the standard 12 and the conical wall 18 for eliminating movement of the standard 12 with respect to the support means 28.

The support means 28 is a standard traffic cone of the type used on roadsides. This type of cone 28 is also widely used by schools for a variety of purposes—often recreational. Typically made from flexible plastic or rubber, the cone 28 comes in various sizes. For purposes of the subject invention, no particular size is more beneficial than any other. Although sometimes, cones made from more flexible material may be more desirable for reasons stated below. The stabilizing means 26 may be adapted to fit any size. The base hole 22 of the traffic cone 28 is larger than the top hole 20. And the cone 28 becomes more narrow as one views it from the base 14 to the top 16. For purposes of the subject invention, it is intended that the base 14 be placed on the ground or other horizontal surface, and that the top 16 is thereby supported above such surface.

The stabilizing means 26 comprises a polyethylene foam member. This material is desirable because it is so inexpensive and durable. Polyethylene foam is available as stock extruded in cylindrical shapes of various sizes. It is therefore simple to adapt the material to fit in a cone 28 simply by cutting or machining the cylindrical stock. Other suitable materials may be used, the cheaper and softer (i.e. safer) ones being the most desireable. The stabilizing means 26, or foam member, includes a top end 30 and a bottom end 32, with the top end 30 including a receiving hole 34 for receiving the standard 12. The receiving hole 34 is disposed coaxial with the top hole 20 of the support means 28. This usually involves locating the receiving hole 34 concentric with the foam member 26. The receiving hole 34 may be of any diameter, but should be sized so that the specific standard to be used fits snugly within the hole 34. The hole 34 may extend completely through the foam member or be fairly shallow, depending on the weight of the standard to be supported. Generally, the hole 34 extends about one third of the way into the foam member 26. The foam member 26 has a cylindrical portion 36 disposed adjacent the bottom end 32 and a frustuconical portion 38 disposed between the cylindrical portion 36 and the top end 30. The respective portions 36,38 are roughly equal in length. In other words, the cylindrical portion 36 extends from the bottom end 32 about halfway up the foam member 26, while the frustuconical portion 38 extends from the halfway point, or where the cylindrical portion 36 ends, up to the top end 30 of the foam member 26. The frustuconical portion 38 has a pitch or angle similar or identical to the pitch or angle of the conical wall 18 of the traffic cone 28. This is so that the surface of the frustuconical portion 38 fully contacts the inner part of the conical wall 18 when the foam member 26 is inserted into the cone 28 a predetermined amount.

The stabilizing means 26, or foam member, is disposed through the base hole 22 of the support means 28 so that the bottom end 32 of the stabilizing means 26 is flush with the base 14 of the support means 28. The support means 28 and the stabilizing means 26 have surfaces engaging for aligning the top hole 20 and the receiving hole 34. In some cases, the top of the cylindrical portion 36 (the part adjacent the frustuconical portion 38) engages the wall whereby the stabilizing means 26 is fixed within the space 24. In such a case, (as shown in FIG. 2) the wall of the cone 28 must stretch to accommodate the foam member 26. Here, the surface area of contact between the foam member and the conical wall 18 of the cone 28 may be no more than a narrow band, or annulus. But this amount of contact is sufficient for purposes of stabilizing a standard 12. Preferably, the frustuconical portion 38 engages the wall whereby the stabilizing means 26 is fixed within the space 24. Here, the entire surface of the frustuconical portion 38 engages the conical wall 18. This is more desirable than the case with the band contact because there is more surface area contact between the cone 28 and the foam member 26, and thus more stability. Whether the surface area contact is greater or lesser, as described above, depends on tolerances. If the fit between the inner part of the conical wall 18 and the frustuconical portion 38 is off, the fit will be more in the area of the cylindrical portion 36, and therefore more circular. Whatever the arrangement, the foam member 26 should fit snugly within the cone 28 so that the foam member does not move with respect to the cone 28.

The assembly 10 may be complete as described above. Any suitable standard 12 may be supported by the assembly 10.

In order to specifically make a hurdle of the type generally indicated at 15, one can also include a standard 12 having a lower member 40 for engaging within the support means 28. The lower member 40 is a hollow cylindrical tube 40 made from plastic or other suitable material.

The standard 12 includes an upper tubular member 42 disposed in telescoping engagement with the lower member 40 for providing height adjustability to the standard 12. The hurdle further includes a horizontal member 44 extending perpendicularly from the upper member 42 of the standard 12. The upper member 42 is a hollow plastic tube. The horizontal member 44 is also a hollow plastic tube. The horizontal member 44 has a first end 48 disposed adjacent to or over said elbow joiner, and a second end 50 disposed opposite from said first end.

Each of the three tubes 40,42,44 is preferably cut from a length of extruded plastic tube. This is a very safe, inexpensive material to use as a standard 12 for a hurdle 15.

The hurdle 15 also includes horizontal support means 46 for supporting the horizontal member 44 at a predetermined angle with respect to the upper member 42. The horizontal support means 46 includes an elbow joiner 46. This is a typical off-the-shelf pipe fitting joiner. This elbow joiner 46 is disposed between the upper member 42 and the horizontal member 44 so that the upper and horizontal members form a right angle. The elbow 46 includes a first prong for fitting in the cylindrical space of the upper member 42, and a second prong for fitting in the cylindrical space at a first end 50 of the horizontal member 44.

Finally, since the horizontal member 44 is a cut length of extruded hard plastic tube, the ends of the tube may have a sharp edge. For safety reasons, the second end 50, or the end away from the elbow joiner 48, i.e. the end at the free end of the member 44, should be covered somehow. In the preferred embodiment, a plastic or rubber cup or cap 52 should be used to cover the free or second end 50. This cap 52 can be bought "off the shelf."

In the assembled state, the hurdle 15 should include the lower member 40 having one end disposed through the top hole 20 of the cone 28 and the receiving hole 34 in the foam member 26. The upper tube member 42 should fit telescopingly over or in the lower member 40. Preferably, the upper member 42 fits within the lower member 40. An elastic washer or "O" ring can be placed around the upper member 42 somewhere along its length. Since the "O" ring cannot fit into the lower member 40, the washer will limit the extent to which the upper member 42 engages within the lower member 40 and maintain the hurdle cross bar at a predetermined height. The elbow joiner 46 fits in the end of the upper member 42 opposite the end which engages within the cone 28. The first end 48 of the horizontal member 44 then engages over the elbow joiner, and is maintained in a horizontal position. The plastic cap or cup 52 is placed over the second end of the horizontal member 44. Height of the the hurdle 15 may be adjusted by manipulating the telescoping engagement between the lower and upper members 40,42.

The invention has been described in an illustrative manner, and it is to be understood that the terminology which has been used is intended to be in the words of description rather than words of limitation.

Obviously, many modifications and variations are possible in light of the above teachings. It is to be understood therefore that within the scope of the appended claims wherein reference numerals are merely for convenience and are not to be in any way limiting, the invention may be practiced otherwise than as specifically described.

We claim as follows:

1. A playground base and standard assembly (10) comprising:

support means (28) including a base (14), a top (16), a conical wall (18) extending between said base (14) and said top, a top hole (20) through said top (16), a base hole (22) through said base (14) and a conical inner space (24) defined by said wall (18) and extending between said base hole (22) and said top hole (20);

a separate stabilizing insert means (26), made of light weight foam material and being disposed within said inner space (24) for supporting a standard (12), said insert (26) defining a receiving hole (34) for receiving the standard into said insert whereby the standard can be in snug contact within said insert;

characterized by said insert (26) having a top portion (38) conical in shape, to engage said conical wall of said support means in a snug fit, below said top hole, in order to a minimize movement of the standard (12) with respect to said support means (28).

2. An assembly as set forth in claim 1 further characterized by said insert (26) including a top end and a bottom end (32), said receiving hole being disposed in said top end (30).

3. An assembly (10) as set forth in claim 2 further characterized by said receiving hole (34) being disposed coaxial with said top hole (20) of said support means (28).

4. An assembly (10) as set forth in claim 3 further characterized by said base hole (22) being larger than said top hole (20).

5. An assembly (10) as set forth in claim 4 further characterized by said insert (26) being disposed through said base hole (22) so that said bottom end (32) of said insert (26) is flush with said base (14) of said support means (28).

6. An assembly (10) as set forth in claim 2 further characterized by said insert (26) defining a cylindrical surface (36) extending below said top portion conical in shape, (38) toward said bottom end (32).

7. An assembly (10) as set forth in claim 1 further characterized by said insert (26) comprising a plastic foam member.

8. An assembly (10) as set forth in claim 1 further characterized by said support means (28) being a standard traffic cone (28).

9. An assembly (10) as set forth in claim 1 further characterized by including a standard (12) having a lower member (40) for engaging within said support means (28).

10. An assembly (10) as set forth in claim 9 further characterized by said lower member (40) being a hollow cylindrical tube.

11. An assembly (10) as set forth in claim 10 further characterized by said standard (12) including an upper tubular member (42) disposed in telescoping engagement with said lower member (40) for providing height adjustability to said standard (12).

12. An assembly (10) as set forth in claim 11 further characterized by including a horizontal member (44) extending perpendicularly from said upper member (42) of said standard (12).

13. An assembly (10) as set forth in claim 11 further characterized by said upper member (42) being a hollow plastic tube.

14. An assembly (10) as set forth in claim 12 further characterized by said horizontal member (44) being a hollow plastic tube.

15. An assembly (10) as set forth in claim 12 further characterized by including horizontal support means (46) for supporting said horizontal member (44) at a predetermined angle with respect to said upper member (42).

16. An assembly (10) as set forth in claim 14 further characterized by said horizontal tube (44) including a first end (48) disposed adjacent said elbow joiner, and a second end (50) opposite said first end, said horizontal member (44) including a cap (52) disposed over said second end (50).

17. An assembly (10) as set forth in claim 15 further characterized by said horizontal support means (46) including a plastic elbow joiner, said elbow joiner (46) being disposed between said upper member (42) and said horizontal member (44) so that said upper and horizontal members form a right angle.

* * * * *